United States Patent [19]

Baud

[11] Patent Number: 4,598,591

[45] Date of Patent: Jul. 8, 1986

[54] APPARATUS FOR DETERMINING THE VARIATIONS IN VOLUME OF AN EXPANDABLE DEFORMABLE CELL EMBEDDED IN SOIL AND SUBJECTED TO INTERNAL PRESSURE GRADIENTS

[75] Inventor: Jean-Pierre Baud, Arpajon, France

[73] Assignee: Intra-Cofor, Paris, France

[21] Appl. No.: 610,869

[22] Filed: May 16, 1984

[30] Foreign Application Priority Data

May 17, 1983 [FR] France ..... 83 08181

[51] Int. Cl.[4] ..... G01N 3/10; G01N 33/24

[52] U.S. Cl. ..... 73/784; 73/149

[58] Field of Search ..... 73/149, 784

[56] References Cited

U.S. PATENT DOCUMENTS 2,957,341 10/1960 Menard ..... 73/149 X
3,772,911 11/1973 Ruppeneit ..... 73/784

FOREIGN PATENT DOCUMENTS 1117983 5/1956 France .
8111630 6/1981 France .
0194033 1/1965 Sweden ..... 73/784

OTHER PUBLICATIONS

Winter, 5 *Geotechnical Testing Journal* (Nos. 3/4, Sep./-Dec. 1982), pp. 85–88.

*Primary Examiner*—S. Clement Swisher
*Attorney, Agent, or Firm*—Gifford, VanOphem, Sheridan & Sprinkle

[57] ABSTRACT

The invention relates to pressuremetric apparatus used to determine the mechanical properties of soil.

The apparatus comprises means which include solenoid valves (10, 14, 19), pressure sensors (11, 16, 20), and an electronic unit (21) which controls the solenoid valves on the basis of information from the sensors and of preselected information, so as to automatically provide a pressure rise, in accordance with the desired program, in the dilatable cell of the pressuremeter.

The invention is useful in controlling the pressure rise in probes of pressuremetric apparatus.

5 Claims, 4 Drawing Figures

APPARATUS FOR DETERMINING THE VARIATIONS IN VOLUME OF AN EXPANDABLE DEFORMABLE CELL EMBEDDED IN SOIL AND SUBJECTED TO INTERNAL PRESSURE GRADIENTS

The invention relates to improvements to apparatus for determining the variations in volume of a dilatable deformable cell embedded in soil and subjected to internal gas pressure gradients.

The principle of such apparatus is set forth in French Pat. No. 1,117,983 of Mr. Louis MENARD in which the apparatus is referred to as a "Pressiomètre" (Pressuremeter) (a registered trademark). Essentially, it comprises a dilatable cell for embedding in soil of which certain mechanical properties are to be determined, means for introducing an expansion liquid into the cell, means for creating a gas pressure above this liquid and means for measuring the variations in volume of the cell as well as the gas pressure. Moreover, such apparatus usually comprises one or more guard cells which accompany the dilatable cell and which are subjected to a gas pressure which is related to the gas pressure above the liquid of the dilatable cell, so as to provide a cylindrical field of stresses during the measurements and to facilitate the deflation of the cell when the test has been completed.

Various apparatus functioning on this principle have been proposed since 1955 and a recent development has been proposed in French Patent Application No. 81/11630. Moreover, this technique for determining the characteristics of soil in-situ has been standardized to some extent, viz.:

STANDARD PRESSUREMETER TEST (working method of the French Central Laboratory for Bridges and Highways), published by DUNOD, Paris, 1971).

STANDARD PRESSUREMETER SURVEYING (D.T.U. 11 of the French Construction Federation).

SUGGESTED PRACTICE FOR PRESSUREMETER TESTING IN SOILS by Ernest WINTER (1982—ASTM).

Reference may also be made to THE PRESSUREMETER AND FOUNDATION ENGINEERING by F. Baguelin, J. F. Jèzèquel and D. H. Shields (Trans Tech Publications, 1978).

The pressuremeter test consists in applying various stages of pressure to the liquid which fills the dilatable cell and in measuring the volumes of the cell corresponding to these stages, which volumes depend on the resistance of the soil surrounding the cell.

The operator, after having determined, to start with, values for the gas pressure stages over the liquid of the dilatable cell, manually operates the gas inlet, while watching the manometer which shows the gas pressure so as to keep this pressure at the desired stage for a certain time and carry out measurement of the volume of liquid in this cell, this operation being repeated for each successive pressure stage.

This technique demands great dexterity so as not to exceed the desired stage and so as to maintain this stage value throughout the duration of this stage. In practice, the pressure drifts during such a stage and it is difficult or even impossible to determine with accuracy the volume corresponding to the desired pressure stage either because this pressure is not achieved or because this pressure is not maintained over a sufficient length of time.

It is an object of the invention to overcome these difficulties.

According to the invention this object is achieved by means of a device which comprises:

a pre-expansion chamber to connect to the source of gas;

a gas line connecting the pre-expansion chamber to a pilot chamber where the pressure of the gas is exerted above a liquid adjoining the dilatable cell;

a gas line connecting the pre-expansion chamber to a buffer chamber connected to one or more guard cells;

a gas pressure sensor adapted to provide a signal $S_1$ representing the value of the pressure $P_1$ of the gas admitted into the pre-expansion chamber;

a solenoid valve adapted to control the admission of gas into the pre-expansion chamber;

a gas pressure sensor adapted to provide a signal $S_2$ representing the value of the pressure $P_2$ of gas in the pilot chamber;

a solenoid valve adapted to control the admission of gas into the pilot chamber;

means of detection adapted to provide a signal $S_3$ representing the pressure difference between the said pressure $P_2$ and the gas pressure $P_3$ in the guard cell or cells;

a solenoid valve adapted to control the admission of gas into the buffer cell and an electronic control unit which receives the signals $S_1$, $S_2$ and $S_3$ and which controls the operations of the solenoid valves in accordance with the predetermined program of the values of $P_3$ and of the desired relationships between $P_3$, $P_2$ and $P_1$, so as to implement this program and these relationships.

The predetermined program of the values of the pressure $P_3$ and of the desired relationships between $P_3$, $P_2$ and $P_1$ are chosen by the operator, for example by following the information in the standard specifications referred to earlier.

The control electronics can be provided without difficulty by an electronics engineer skilled in the art, if duly advised of this program and of these relationships.

A DESCRIPTION OF A PREFERRED EMBODIMENT

An embodiment of the invention is described below with reference to the Figures in the attached drawing, in which.

Figure 1:
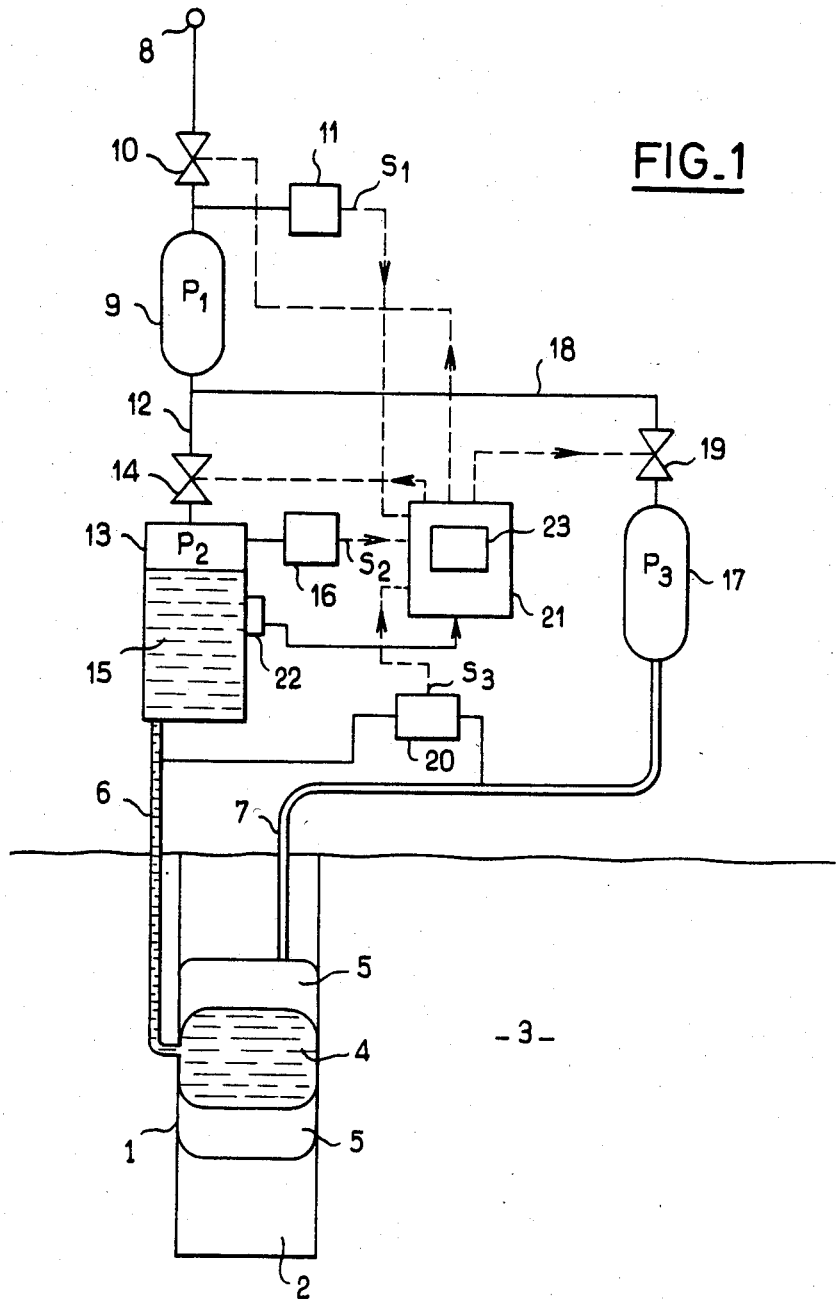
FIG. 1 illustrates the principle of the device.

In the diagram in FIG. 1, the measuring probe 1 embedded in a drill-hole 2 in soil 3 comprises a dilatable cell 4 and two communicating guard cells 5. This is but one embodiment, and the invention is not limited thereto.

The dilatable cell is filled with an incompressible fluid, generally water, and is connected to the surface by a line 6 through which this liquid may be introduced or removed. The guard cells are connected to the surface by a line 7 through which a gas, for example air or nitrogen, may be introduced into these cells.

A source of compressed air 8 is used after expansion to a pressure $P_1$ to provide a pressure $P_2$ which is exerted on the fluid in the dilatable cell and a pressure $P_3$ which is exerted in the guard cells.

During a pressuremeter test, the pressure $P_2$ must rise from a value of zero to a final value via an arithmetic series of pressure stages, each stage being maintained for a constant period selected beforehand.

(a) If $P_{lim}$ is the limiting pressure (assessed beforehand) and N is the number of stages, the step of the $P_2$ arithmetic increase program is $P_{lim}/N$.

The duration T of each stage is usually fixed at 60 seconds but in fact different durations (for example, 30 seconds) may be chosen.

The number of steps of a test is generally 10 but a different number may also be chosen.

The $P_2$ pressure rise program is thus chosen beforehand on the basis of an estimated value of $P_{lim}$ and a choice of N and T.

(b) The pressure $P_3$ is generally related to the pressure $P_2$ in such a manner that the pressure difference $P_3-P_2$ is:

$$P_3-P_2=0.1\times H-1.1$$

where H is the depth of the measuring cell expressed in meters and where the pressures P are expressed in bars.

(c) The pressure $P_1$ is generally regulated so that $$P_1 \geqq P_{lim}+K$$

where $P_{lim}$ is the limiting pressure (estimated beforehand) expressed in bars. The constant K is so chosen that, even if the limiting pressure has been underestimated, $P_1$ is nevertheless greater than the real value of $P_{lim}$. A generally adequate safety margin is to take K=20.

The device of the invention for providing an automatic rise in $P_2$ in accordance with the chosen program comprises a pre-expansion chamber 9 connected to the source of gas 8 via a solenoid valve 10, a sensor 11 for detecting the gas pressure $P_1$ in the chamber 9 (which sensor may detect this pressure in the chamber either upstream or downstream of the said chamber); a pilot chamber 13 connected to the pre-expansion chamber 9 by a line 12 controlled by a solenoid valve 14, this pilot chamber containing a liquid 15 on which is exerted the pressure $P_2$ of the gas in the pilot chamber and the said liquid 15 being in communication with the dilatable cell 4; a sensor 16 for detecting the pressure $P_2$ (which sensor detects the pressure in the pilot chamber or on the path of the liquid 15 to the dilatable cell); a buffer cell 17 connected to the pre-expansion chamber 9 by a line 18 controlled by a solenoid valve 19 and connected to the line 7 which leads to the guard cells; a differential sensor 20 which detects the pressure difference between the gas pressure $P_2$ of the pilot chamber 13 and the gas pressure $P_3$ of the buffer cell 17; and an electronic control unit 21 which receives the output signals $S_1$, $S_2$ and $S_3$ of the sensors 11, 16 and 20 and which controls the solenoid valves 10, 14, 19 so as to implement the program defined under (a) and the relationships defined under (b) and (c). In short, this electronic unit implements the program of rise of pressure $P_2$ on the basis of the data input by the operator (estimated $P_{lim}$, depth of the measuring cell, and number and duration of stages).

The values of the volume of the dilatable cell, which may, for example, be determined by following the variations in the volume V of liquid 15 in the pilot cell 13, are moreover sensed by any suitable means 22 and are read for each pressure stage by the unit 21. A screen 23 allows the pairs $P_2$, V to be displayed for each stage.

In practice the device can be more complicated, depending on the type of pressuremeter used.

Figure 2:
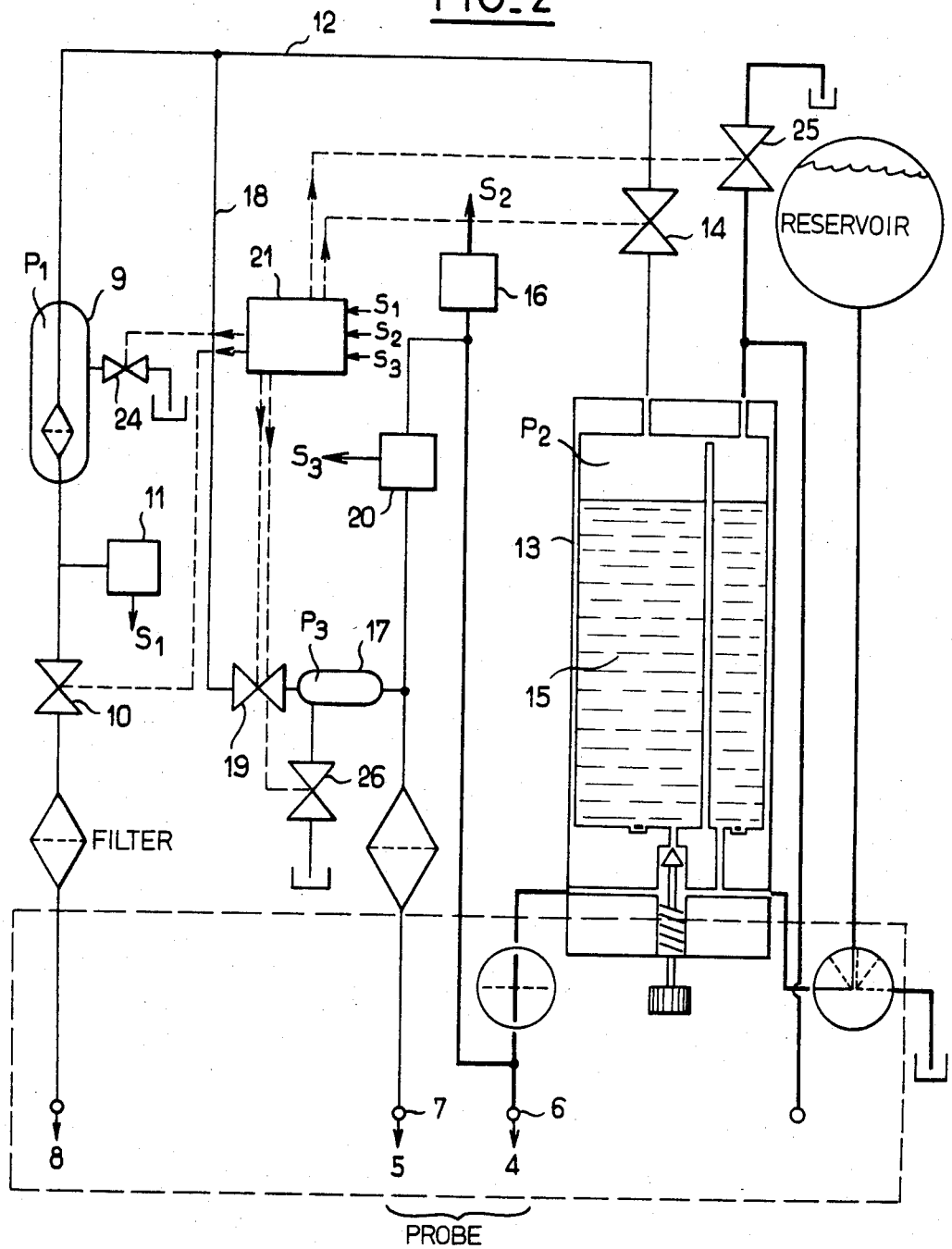
FIG. 2 shows a view of an embodiment of the device of the invention.

FIG. 2 is an example of a device designed for a commercial pressuremeter.

It will be seen in this Figure that the device is supplemented by the solenoid valves 24, 25, 26 which control, as required, the setting of the pre-expansion chamber 9, the pilot chamber 13 and the buffer cell 17 to a gas escape setting. These solenoid valves are also controlled by the electronic unit 21 during the phase of reducing the pressure $P_2$ when deflating the dilatable cell 4.

Each inlet solenoid/escape solenoid combination can consist of a single solenoid valve, in a manner known per se.

In an improved embodiment, the electronic unit is designed to provide a certain number of safety measures, in particular the following operations:

stopping the test prematurely if the volume of the dilatable cell approaches the limiting capacity of this cell (for example if this volume exceeds 550 $cm^3$ for a limiting capacity set at 600 $cm^3$).

stopping the test prematurely if the pressure $P_2$ approaches a safety limit, for example a pressure of 70 bars.

calculating, from the first measurements, the pressuremeter module $$E=\frac{8}{3}\left(V_{REF}+\frac{V_{(i)}+V_{(i-1)}}{2}\right)\left(\frac{P_{(i)}-P_{(i-1)}}{V_{(i)}-V_{(i-1)}}\right)$$

(where $V_{REF}$, which depends on the probe, is for example 585), deducing the corresponding limiting pressure value $$P'_{lim}=E/10'$$

comparing this value with the $P_{lim}$ estimated beforehand, correcting the value of the step if the ratio $P'_{lim}/P_{lim}$ is outside a chosen range A–B (where A is, for example, a number within the range of 0.4–1.5 and B is, for example, a number within the range 1.5–3) and initiating a fresh test with the new value of the step.

Figure 4:
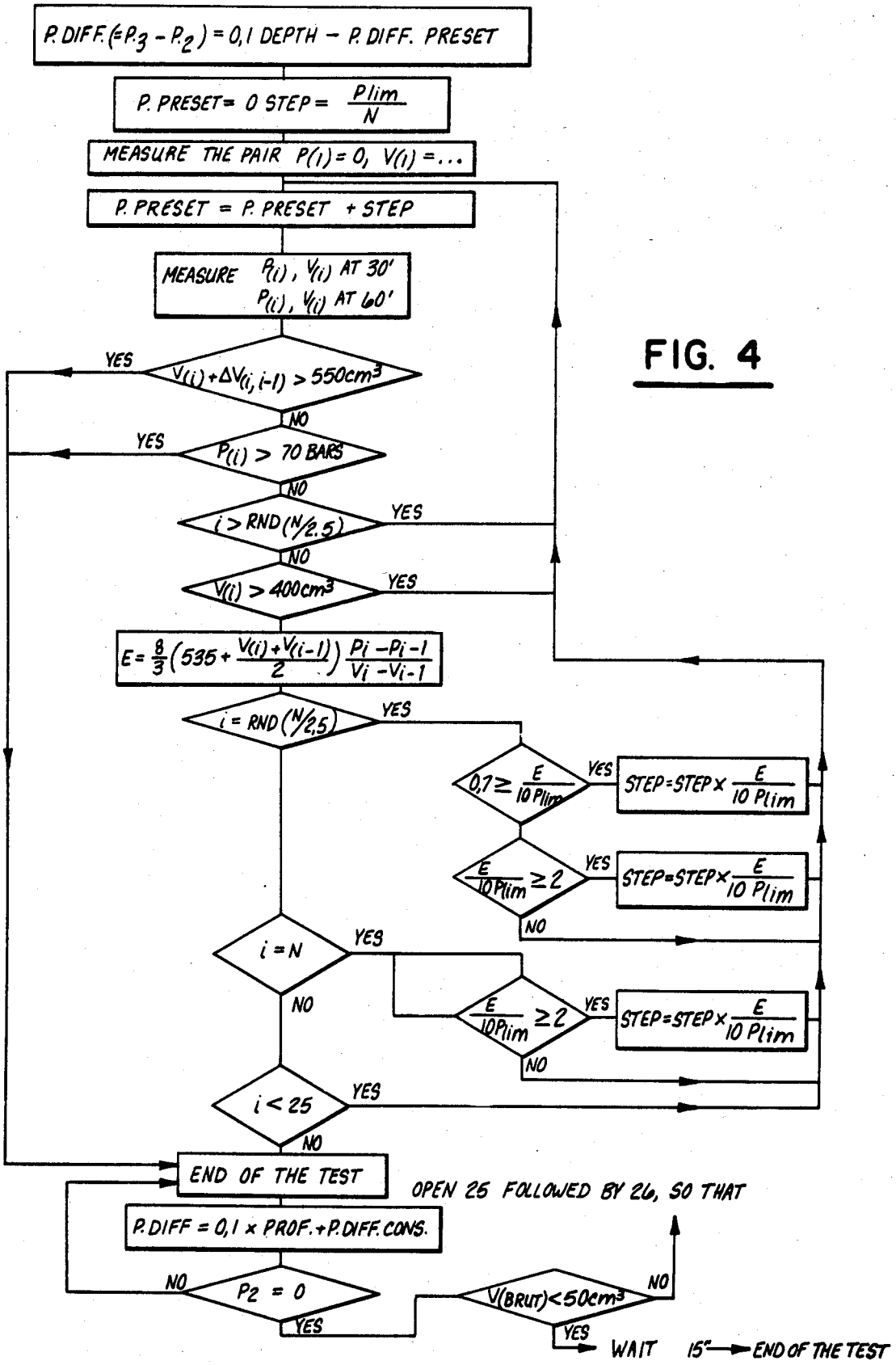
FIG. 4 is a flow diagram illustrating operation of the preferred embodiment of the present invention.

FIG. 4 is a flow chart which illustrates a mode of operation of the electronic unit. In this figure, the index i means that the value indicated corresponds to the stage (i) of the arithmetic series of stages of the pressure $P_2$. In this figure, RND (N/2.5) means the rounded-off value of N/2.5.

FIG. 4 is a typical example of the information useful to a man skilled in the electronics art for enabling him to set up a control unit from microprocessors, transistors and the like.

Figure 3:
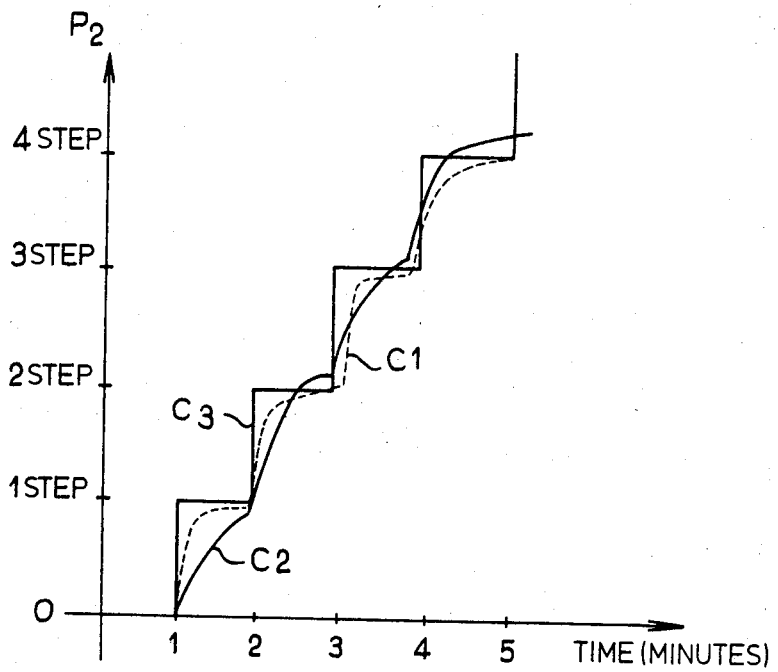
FIG. 3 shows different pressure rise curves obtained by manual control, or in accordance with the present invention.

FIG. 3 shows examples of the pressure rise curves obtained with reasonably skilled, manual control (curves $C_1$ and $C_2$) or with automatic control (curve $C_3$).

I claim:

1. Apparatus for determining the variations in volume of a dilatable cell, this cell being filled with an incompressible fluid subjected to the pressure of a gas coming from a gas source and this cell being accompanied by one or more guard cells also subjected to gas pressure, the combination of the expandable cell and the guard cell or cells constituting a probe for embedding in soil of which the mechanical properties are to be determined, the said apparatus comprising:

a pre-expansion chamber to connect to the source of gas;

a gas line connecting the pre-expansion chamber to a pilot chamber where the pressure of the gas is exerted above a liquid adjoining the dilatable cell;

a gas line connecting the pre-expansion chamber to a buffer chamber connected to one or more guard cells;

a gas pressure sensor adapted to provide a signal $S_1$ representing the value of the pressure $P_1$ of the gas admitted into the pre-expansion chamber;

a solenoid valve adapted to control the admission of gas into the pre-expansion chamber;

a gas pressure sensor adapted to provide a signal $S_2$ representing the value of the pressure $P_2$ of gas in the pilot chamber;

a solenoid valve adapted to control the admission of gas into the pilot chamber;

means of detection adapted to provide a signal $S_3$ representing the pressure difference between the said pressure $P_2$ and the gas pressure $P_3$ in the guard cell or cells;

a solenoid valve adapted to control the admission of gas into the buffer cell and an electronic control unit which receives the signals $S_1$, $S_2$ and $S_3$ and which controls the operations of the solenoid valves in accordance with the predetermined program of the values of $P_3$ and of the desired relationships between $P_3$, $P_2$ and $P_1$, so as to implement this program and these relationships.

2. Apparatus as claimed in claim 1, which comprises solenoid valves which respectively control the setting of the pre-expansion chamber, the pilot chamber and the buffer cell to a gas escape setting, these solenoid valves being controlled by the said electronic unit during the phase of reducing the pressure $P_2$ when deflating the dilatable cell.

3. Apparatus as claimed in claim 1 or 2, wherein the said electronic unit is designed to stop the test prematurely if the volume of the dilatable cell approaches the limiting capacity of the said cell.

4. Apparatus as claimed in claim 1, wherein the said electronic unit is designed to stop the test prematurely if the said gas pressure of the pilot chamber approaches a safety limit.

5. Apparatus as claimed in claim 1, wherein the said electronic unit is designed to compute the limiting value corresponding to the pressuremeter module, compare this value to the limiting pressure estimated beforehand, correct the value of the step if the ratio of the two values is outside a chosen range and initiate a fresh test with the new value of the step.

* * * * *

UNITED STATES PATENT AND TRADEMARK OFFICE

CERTIFICATE OF CORRECTION

PATENT NO. : 4,598,591

DATED : July 8, 1986

INVENTOR(S) : Jean-Pierre Baud

It is certified that error appears in the above-identified patent and that said Letters Patent is hereby corrected as shown below:

Title page:

Please change the name of the Assignee from

"Intra-Cofor" to --Intrafor-Cofor--.

Signed and Sealed this

Third Day of November, 1987

*Attest:*

*Attesting Officer*

DONALD J. QUIGG

*Commissioner of Patents and Trademarks*